US007176779B2

(12) United States Patent
Miettinen

(10) Patent No.: US 7,176,779 B2
(45) Date of Patent: Feb. 13, 2007

(54) INDUCTOR ARRANGEMENT

(75) Inventor: Erkki Miettinen, Helsinki (FI)

(73) Assignee: ABB Oy, Helsinki (FI)

( * ) Notice: Subject to any disclaimer, the term of this patent is extended or adjusted under 35 U.S.C. 154(b) by 115 days.

(21) Appl. No.: 10/934,737

(22) Filed: Sep. 7, 2004

(65) Prior Publication Data

US 2005/0068144 A1 Mar. 31, 2005

(30) Foreign Application Priority Data

Sep. 23, 2003 (FI) ..... 20031371

(51) Int. Cl.
*H01F 27/27* (2006.01)
*H01F 30/12* (2006.01)

(52) U.S. Cl. ..... 336/212; 336/5

(58) Field of Classification Search ..... 336/212, 336/5, 12, 180, 182
See application file for complete search history.

(56) References Cited

U.S. PATENT DOCUMENTS 3,770,995 A * 11/1973 Eastham et al. ..... 104/294
5,424,899 A 6/1995 Rustebakke et al.
6,070,317 A 6/2000 O'Connor et al.
6,400,579 B2 6/2002 Cuk
6,549,369 B1 * 4/2003 Masuda et al. ..... 360/126
2002/0125854 A1 9/2002 Williamson

FOREIGN PATENT DOCUMENTS

| | | | |
|---|---|---|---|
| DE | 3023403 | | 1/1981 |
| DE | 199338811 | | 1/2001 |
| EP | 0012629 | | 6/1980 |
| JP | 56054019 | | 5/1991 |
| JP | 03241719 | A * | 10/1991 |
| JP | 07263262 | | 10/1995 |
| JP | 07283049 | A * | 10/1995 |
| JP | 11204355 | | 7/1999 |

OTHER PUBLICATIONS

EP Search Report Jan. 17, 2005.

* cited by examiner

*Primary Examiner*—Anh Mai
(74) *Attorney, Agent, or Firm*—Dykema Gossett PLLC

(57) ABSTRACT

An inductor arrangement for a frequency converter or corresponding electrical apparatus, the inductor arrangement comprising an input inductor coupled to the input side of the electrical apparatus and an output inductor coupled to the output side of the apparatus, the input inductor comprising a core element having yokes and columns, and several winding turns for each phase formed around the core element. The output inductor is provided in the inductor arrangement by placing a predetermined length of a conductor of each phase in the output of said electrical apparatus adjacent to the core element of the input inductor.

10 Claims, 1 Drawing Sheet

INDUCTOR ARRANGEMENT

BACKGROUND OF THE INVENTION

The invention relates to inductor arrangements comprising an input inductor coupled to the input side of an electrical apparatus and an output inductor coupled to the output side of the apparatus.

Input and output inductors are used to reduce interference that an electrical apparatus causes to the input and output side networks. Input and output inductors are used for instance in frequency converter configurations.

In frequency converters, rectification is typically implemented by means of a six-pulse diode bridge, which is known to use line current only at the surroundings of the peak voltage of a sequence, thus causing extensive current pulses that stress the network. In order to reduce the amplitude of these current pulses it is known in the art to use series inductors, i.e. input inductors, placed in the feeding phases.

Power inversion and pulse-width modulation used to control the output voltage level of the fundamental wave cause extremely rapidly ascending and descending edges, a kind of surge waves, to the output voltage. These surge waves may create two types of problems in the motor to be fed: high turn voltages of the winding including the risk of discharge and bearing currents. In order to attenuate each of the mentioned phenomena it is known in the art to employ phase-specific series inductors, i.e. output inductors, to be placed at the beginning of a motor cable at the output side of the frequency converter that allow smoothing the voltage edges observable in the terminals of the motor.

An input inductor is generally a three-columned and two-windowed three-phase inductor assembled of columns and yokes composed of armature sheets and copper or aluminium windings. The magnetic path is provided with one or more air gaps that prevent the magnetic core from being saturated. Such a component intended for a network frequency is typically the largest and heaviest part of the entire converter.

The output inductor that smoothes the surge waves observable in the terminals of the motor could electrically be most optimal when it would only affect with frequency components of such a magnitude that only the edges of the surge voltages were smoothed.

The structure of an output inductor according to the prior art is similar to the input inductor. However, such an output inductor also attenuates a component of base frequency, whereby the terminal voltage of the motor is reduced. Such an inductor is also so massive that it cannot be placed into the specific frequency converter as an optional component, instead it is separately mounted.

Output inductor structures are also known which are effective only in high frequency components. What are used are for instance rings made of a material provided with an extremely high specific permeability that positioned around output busbars attenuate the voltage transients. A drawback with these components is that they are very expensive. Consequently they are generally used only as a "common mode" inductor, which is common for all phases, whereby the effect is restricted merely to prevent bearing currents. Another problem with such rings is the relatively large size thereof.

Another structure in use, which is only effective in large frequency components, comprises an inductor bar provided with an open magnetic path placed in each output phase, the structure of such an inductor bar resembles a winding around a pile of armature sheets. The problems associated with this structure include high costs and a fairly extensive need for space.

BRIEF DESCRIPTION OF THE INVENTION

It is an object of the invention to provide an inductor arrangement comprising input and output inductors for a frequency converter or a corresponding electrical apparatus so as to solve the problems mentioned above. The object of the invention is achieved with an inductor arrangement, characterized in what is stated in independent claim 1. The preferred embodiments of the inductor arrangement are disclosed in the dependent claims.

The invention is based on the idea that a core element of an input inductor is also utilized in the structure of an output inductor. In the inductor arrangement according to the invention, the output inductor is provided by placing a certain portion of a conductor in each phase of the output adjacent to the core element of the output inductor so that at least a part of the magnetic flux formed around the output conductor may penetrate into the core element. In the inductor arrangement according to the invention the input and output inductor are in a sense combined.

The advantages of the inductor arrangement according to the invention in comparison with the prior art solutions are a less significant need for space and weight and more advantageous manufacturing costs.

BRIEF DESCRIPTION OF THE DRAWINGS

In the following the invention will be explained in greater detail by means of the preferred embodiments with reference to the accompanying drawings, in which.

DETAILED DESCRIPTION OF THE INVENTION

Figure 1:
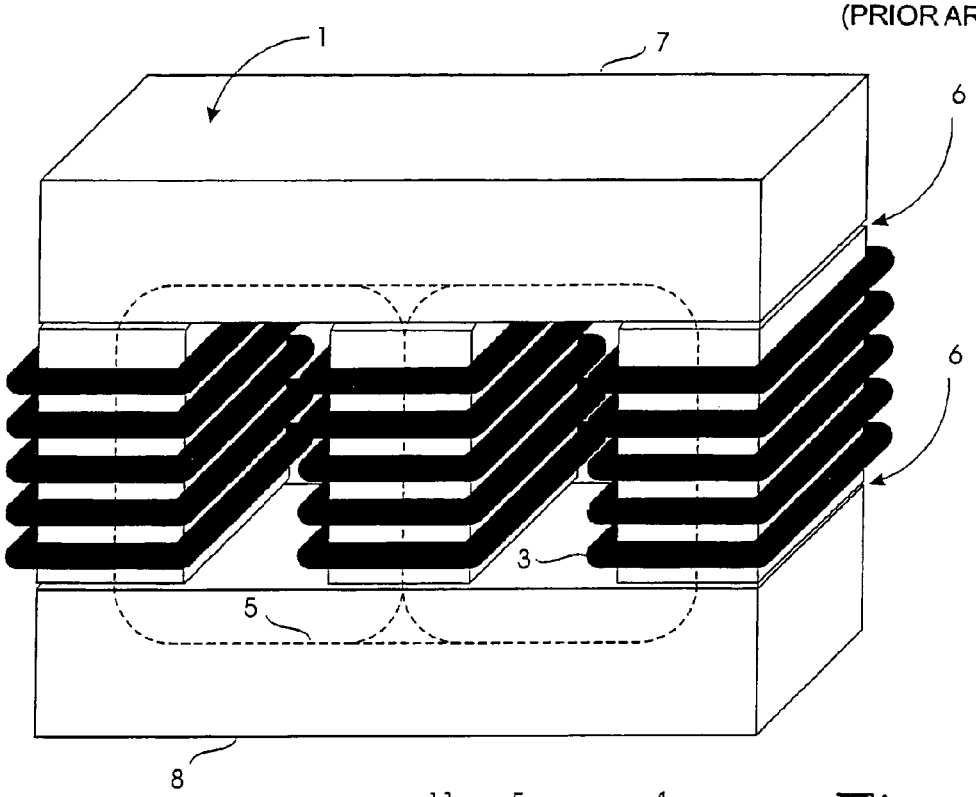
Fig. 1 (PRIOR ART)
FIG. 1 shows a side view of a prior art input conductor seen obliquely from the top.

FIG. 1 shows a typical three-phase input inductor of a frequency converter, in which the routes along which magnetic fluxes 5 travel and close are also indicated. A core element 1 is composed of thin armature sheets in such a manner that the magnetic flux 5 formed around winding turns 3 of the input current of the frequency converter travels along the armature sheet everywhere except in air gaps 6 created on purpose. The magnetic flux 5 is most dense in the corners of the windows and most sparse in the outer corners and back parts of yokes 7 and 8.

Figure 2:
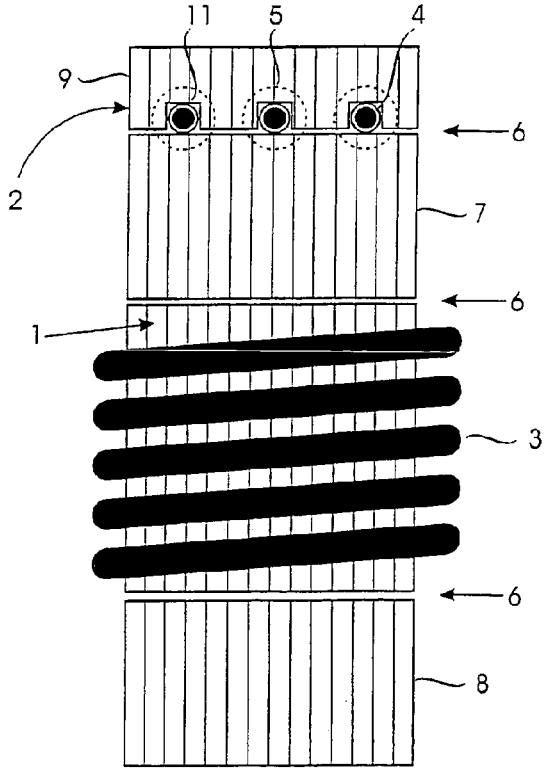
FIG. 2 shows an inductor arrangement according to an embodiment of the invention seen from the end of the inductor structure.

FIG. 2 shows an inductor arrangement according to an embodiment of the invention seen from the end of the inductor structure. The inductor arrangement in FIG. 2 is formed of the input inductor of FIG. 1 by placing a predetermined length of insulated current conductors 4 of the output of the frequency converter adjacent to the core element 1 of the input inductor, and by adding an additional yoke 9 made of armature sheet adjacent to the upper yoke 7 so that each conductor 4 remains between the upper yoke 7 and the additional yoke 9.

In the structure shown in FIG. 2, the additional yoke 9 is made of a similar armature sheet as the core element 1, and the armature sheets of the additional yoke 9 are placed in parallel with the armature sheets of the core element 1.

In the arrangement shown in FIG. 2, the conductors 4 of the output of the frequency converter are placed along the back surface of the upper yoke 7 so that the conductors 4 are substantially parallel with the main direction of travel of the magnetic flux caused by the input current of the frequency converter and passing through the upper yoke 7 adjacent to the conductors. Then, the magnetic flux formed around each conductor by impact of the output current of the frequency converter penetrates into the upper yoke 7 in such a manner that the travel route thereof is substantially perpendicular in relation to the main direction of travel of the magnetic flux caused by the input current of the frequency converter, in which case the effect of the magnetic flux of the output inductor 2 on the magnetic flux of the input inductor is practically non-existent.

In the inductor arrangement illustrated in FIG. 2, the additional yoke 9 is provided with grooves 11 for the conductors 4. In the arrangement of FIG. 2 the grooves 11 are almost as deep as the conductors 4 so that the distance between the additional yoke 9 and the upper yoke 7 equals the size of the air gap 6. The magnetic flux 5 of each conductor 4 is thus closed through the yoke 7, the additional yoke 9 and two air gaps 6.

In the inductor arrangement according to a preferred embodiment of the invention the grooves 11 of the additional yoke 9 are formed to be as deep as the diameter of the conductor 4, whereby the magnetic flux formed by the current moving in the conductor 4 does not pass through a single actual air gap 6, but through several small air gaps formed of the surface insulator in the armature sheets. The division of an air gap into several parts along the route of the magnetic flux is preferable in view of the saturation and loss of the core element 1 and the additional yoke 9. If the small air gaps formed of the surface insulator of the armature sheets do not provide a sufficiently large air gap for the magnetic path, then an "actual" air gap 6 can be formed between the additional yoke 9 and the upper yoke 7 in accordance with FIG. 2.

The inductor arrangement according to the invention can also be implemented also without the additional yoke 9 placed adjacent to the core element 1, whereby the magnetic flux of each conductor 4 is closed mainly through the air. Thus the inductance of the output inductor 2 is substantially smaller than when the structure illustrated in FIG. 2 is used.

The additional yoke 9 is therefore used for increasing the inductance of the output inductor 2. Shaping the additional yoke 9 appropriately enables to dimension the inductance of the output inductor as desired. The more armature sheets on the magnetic path, the greater the inductance.

In the solution shown in FIG. 2 the additional yoke 9 is provided with three grooves 11, in other words one groove 11 for each phase. Each groove 11 is of the same length as the additional yoke 9. Each groove 11 is provided with one conductor 4 of the output of the frequency converter. Each conductor 4 thus proceeds alongside the core element 1 a distance that substantially equals the size of the upper yoke 7.

The distance that each conductor 4 of the output of the frequency converter moves alongside the core element 1 may be shorter or longer than in the solution shown in FIG. 2. Placing the conductors 4 over a longer distance adjacent to the core element 1 allows increasing the inductance of the output inductor 2, and vice versa.

The same groove 11 may be provided with several portions of the same conductor 4. The additional yoke 9 may also comprise more than one groove 11 for one phase, in which case each groove 11 is provided with one or more portions of the same conductor 4.

The inductor arrangement according to the invention may comprise more than one additional yokes. In addition to an additional yoke 9 placed adjacent to the upper yoke 7, another additional yoke may be provided that is placed adjacent to the lower yoke 8. The additional yoke placed adjacent to the lower yoke 8 may be similar to the additional yoke 9 placed adjacent to the upper yoke 7. It is obvious that all additional yokes are placed adjacent to the conductors 4 of the output of the frequency converter. If an additional yoke is thus placed adjacent to the lower yoke 8, then a portion of the conductors 4 is placed between the lower yoke 8 and the additional yoke.

The grooves 11, in which the conductors 4 of the output side are placed, can be formed in the inductor arrangement according to the invention in the additional yoke or in the yoke of the core element 1 of the input inductor. It is also possible to provide an inductor arrangement, in which both the additional yoke and the yoke of the input inductor comprise grooves 11 arranged to receive the conductors 4.

The inductor arrangement in which the grooves of the conductors 4 are placed in the yoke of the input inductor can be implemented without the additional yoke 9 or with the additional yoke 9.

The inductor arrangement according to the invention is applicable to be used with such electrical apparatuses that provide interference of the above-mentioned type typical for the frequency converters to the input and output inductors thereof. The inductor arrangement according to the invention can be implemented as a single or multiple phase inductor arrangement.

It has been noted in the above specification that armature sheet can be used for manufacturing the core element 1 and the additional yoke 9. Here, armature sheet refers to a thin sheet made of steel provided with an insulated surface. The armature sheet is employed in magnetic circuits to reduce eddy-current losses. Especially when transformers are concerned the same thin sheet provided with an insulated surface is referred to as the transformer sheet.

It is apparent for those skilled in the art that the basic idea of the invention can be implemented in various ways. The invention and the embodiments thereof are therefore not restricted to the above examples but may vary within the scope of the claims.

The invention claimed is:

1. An inductor arrangement comprising: an input inductor adapted to be coupled to the input side of an electrical apparatus and an output inductor adapted to be coupled to the output side of the electrical apparatus, the input inductor comprising a core element having yokes and columns, and several winding turns for each phase formed around the core element, wherein the output inductor includes for each phase a conductor, which is adapted to be coupled to the output of the electrical apparatus, and a predetermined length of which is placed adjacent to the core element of the input inductor such that during use a magnetic flux induced around the conductor by an output current of the electrical apparatus penetrates into a part of the core element of the input inductor in such a manner that the travel route of the magnetic flux is substantially perpendicular in relation to the main direction of travel of a magnetic flux induced by the input current of the electrical apparatus in said part of the core element.

2. An inductor arrangement as claimed in claim 1, wherein a yoke of the core element of the input inductor is provided with a groove for each conductor placed adjacent to the core element in order to receive the conductor.

3. An inductor arrangement as claimed in claim 1, wherein the core element of the input inductor comprises at least two yokes and at least two columns such that the winding turns of the input inductor are formed around a column, and the part of the core element into which the magnetic flux induced by the output current penetrates is a yoke.

4. An inductor arrangement as claimed in claim 1, wherein it comprises at least one additional yoke placed adjacent to the yoke of a core element of the input inductor in such a manner that the predetermined length of the conductors placed adjacent to the core element is between the additional yoke and the yoke.

5. An inductor arrangement as claimed in claim 4, wherein an air gap is provided between the additional yoke and the yoke of the core element of the input inductor.

6. An inductor arrangement as claimed in claim 4, wherein the additional yoke is provided with a groove for each conductor in order to receive said conductor.

7. An inductor arrangement as claimed in claim 6, wherein an air gap is provided between the additional yoke and the yoke of the core element of the input inductor.

8. An inductor arrangement as claimed in claim 6, wherein the core element and the additional yoke are formed of armature sheets and that the armature sheets of the core element and the additional yoke are placed parallel to each other.

9. An inductor arrangement as claimed in claim 4, wherein the core element and the additional yoke are formed of armature sheets and that the armature sheets of the core element and the additional yoke are placed parallel to each other.

10. An inductor arrangement as claimed in claim 9, wherein an air gap is provided between the additional yoke and the yoke of the core element of the input inductor.

* * * * *